United States Patent [19]

Pristo et al.

[11] Patent Number: 4,792,095

[45] Date of Patent: Dec. 20, 1988

[54] BUFFERED, FLUID DISPENSING NOZZLE UNIT

[76] Inventors: Paul J. Pristo, 1045 E. Curry Pl., Tempe, Ariz. 85281; Joseph H. Fagan, 1505 N. Hayden Rd., #6, Scottsdale, Ariz. 85257

[21] Appl. No.: 38,998

[22] Filed: Apr. 16, 1987

[51] Int. Cl.[4] ..... B05B 15/10; B05B 3/06; E04H 3/20; B08B 3/02

[52] U.S. Cl. ..... 239/204; 239/206

[58] Field of Search ..... 239/200, 201, 203, 204, 239/206, 251, 256, 259, 261, 264

[56] References Cited

U.S. PATENT DOCUMENTS

| | | | |
|---|---|---|---|
| 2,360,203 | 10/1944 | Cox | 239/204 |
| 4,188,673 | 2/1980 | Carter | 239/206 |
| 4,322,860 | 4/1982 | Gould | 239/204 |
| 4,391,005 | 7/1983 | Goettl | 239/204 |
| 4,535,937 | 8/1985 | Fagan et al. | 239/206 |

*Primary Examiner*—Andres Kashnikow

*Assistant Examiner*—Karen B. Merritt

*Attorney, Agent, or Firm*—Nissle & Leeds

[57] ABSTRACT

An improved nozzle unit for periodically dispensing a fluid. The nozzle unit includes a fluid dispensing component mounted for confined displacement in a housing having first and second stop surfaces. The fluid dispensing component, when subjected to a displacement force produced by fluid flowing into the housing under pressure, moves from a primary stored position against the first stop surface to impact the second stop surface in a deployed position in which fluid flows through the dispensing component. At least one of the dispensing component and the housing is shaped and dimensioned to cause fluid flowing through the housing under pressure to produce fluid flow forces counteracting the displacement force which moves the dispensing component from the stored position to the deployed position. The fluid flow forces counteracting the impact force minimize material fatigue caused by the impact force and extend the operational life of the nozzle unit.

2 Claims, 2 Drawing Sheets

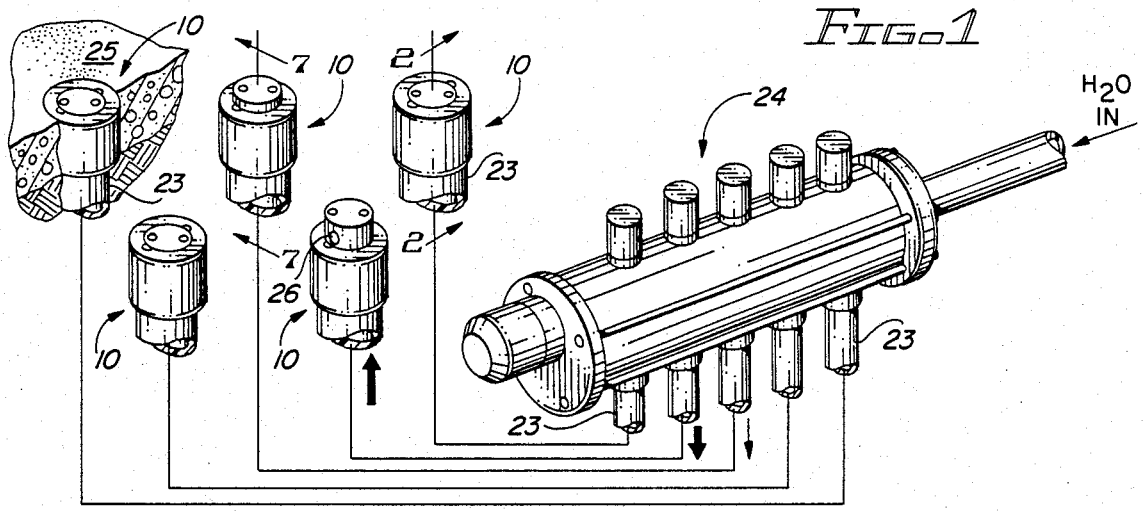
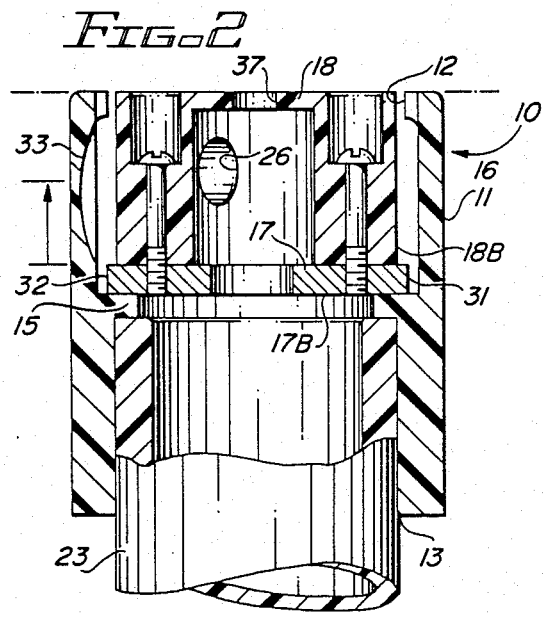
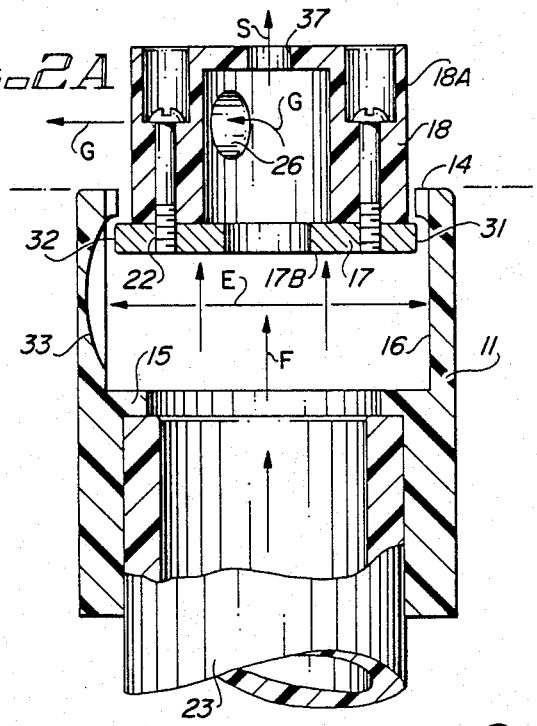
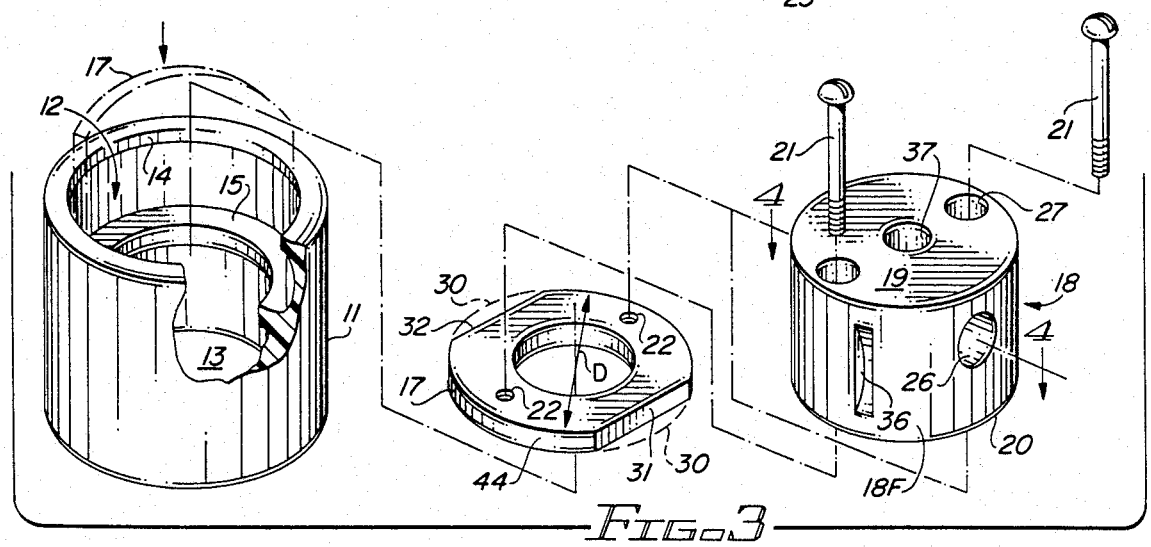
FIG. 3

BUFFERED, FLUID DISPENSING NOZZLE UNIT

This invention relates to nozzle units for periodically dispensing a fluid.

More particularly, this invention relates to a nozzle unit including a fluid dispensing component mounted for confined displacement in a housing having first and second stop surfaces, the fluid dispensing component, when subjected to a displacement force produced by fluid flowing into the housing under pressure, moving from a primary stored position against the first stop surface to impact the second stop surface in a deployed position in which fluid flows through the dispensing component.

In a further respect, the invention relates to a nozzle unit of the type described in which at least one of the fluid dispensing component and the housing is shaped and dimensioned to cause fluid flowing through the housing under pressure to produce fluid flow forces counteracting the displacement force which moves the dispensing component from the stored position to the deployed position, the counteracting forces reducing the impact force of the dispensing component against the stop surface to minimize material fatigue caused by such impact and, accordingly, to extend the operational life of the nozzle unit.

In our U.S. Pat. No. 4,535,937, incorporated herein by reference, we describe an improved pop-up nozzle unit for a swimming pool. As is illustrated in FIGS. 2 to 4 of our patent, the nozzle unit 10 includes a water dispensing component including cylinder 18 and annular weight or member 17 slidably mounted in housing 11. In FIG. 2, weight 17 rests against a first inwardly extending shoulder or stop surface 15. When pressurized fluid is directed into housing 11, the fluid generates a displacement force against annular member 17 to displace member 17 and cylinder 18 upwardly until annular member 17 impacts a second inwardly extending shoulder or stop surface 14. Over time, the repeated impacting under fluid pressure of annular member 17 against shoulder 14 causes shoulder 14 to fracture, requiring repair or replacement of unit 10.

Accordingly, it would be highly desirable to provide an improved fluid dispensing nozzle unit of the type described which would reduce the impact force of the fluid dispensing component against the second stop surface when the fluid dispensing component is displaced under fluid pressure against the second stop surface.

Therefore, it is a principal object of the invention to provide an improved nozzle unit for periodically dispensing a fluid.

A further object of the invention is to provide an improved fluid dispensing nozzle unit which includes a water dispensing component mounted for confined reciprocal displacement in a housing having first and second stop surfaces, the dispensing component, when subjected to a displacement force produced by fluid periodically flowing under pressure into the housing, moving from a primary stored position against the first stop surface to impact the second stop surface in a deployed position in which fluid flows through the dispensing component.

Another object of the invention is to provide an improved fluid dispensing nozzle unit of the type described in which at least one of the water dispensing component and the housing is shaped to cause fluid flowing through the housing to generate forces counteracting the displacement force moving the dispensing component from the stored position to the deployment position, the counteracting forces buffering the force of impact of the dispensing unit against the second stop and extending the operational life of the nozzle unit.

Still a further object of the instant invention is to provide an improved fluid dispensing unit of the type described in which the shape and dimension of the fluid dispensing component, while inducing fluid flow which produces forces buffering the impact force of the dispensing component against the second stop surface, facilitates assembly of the nozzle unit.

Yet a further object of the invention is to provide an improved fluid dispensing unit of the type described which includes a resilient component for buffering the impact force of the fluid dispensing component against the second stop surface.

These and other, further and more specific objects and advantages of the invention will be apparent to those skilled in the art from the following detailed description thereof, taken in conjunction with the drawings, in which:

FIG. 1 is a perspective view of apparatus constructed in accordance with the principles of the invention;

FIG. 2 is a section view of a nozzle unit of the apparatus of FIG. 1 taken along section line 2—2 thereof and further illustrating construction details thereof;

FIG. 2A is a front view of the nozzle unit of FIG. 2 illustrating the mode of operation thereof;

FIG. 3 is an expolded assembly view further illustrating the housing and fluid dispensing component of the nozzle unit of FIGS. 2 and 2A;

Figure 5:
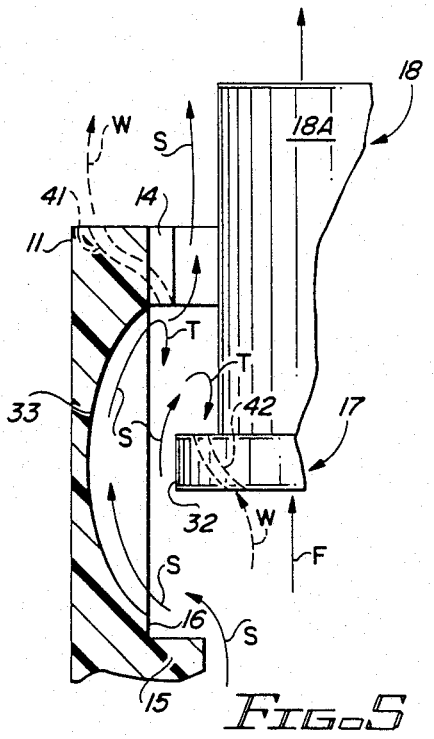
FIG. 5 is a partial front section view of the nozzle unit of FIGS. 2 and 3 further illustrating the mode of operation thereof.

Briefly, in accordance with our invention, we provide an improved hydraulically actuated nozzle unit. The unit includes a housing having first and second open ends, a cylindrical inner wall, first shoulder means attached to and inwardly extending from said inner wall, and second shoulder means spaced apart from said first shoulder means and inwardly extending from said inner wall; annular means interposed in said housing between said first and second shoulder means for captive slidable displacement therebetween; cylindrical conduit means connected to and extending away from said annular means toward said second end of said housing. The cylindrical conduit means includes an upper end having an outer wall spaced apart from the inner wall of the housing and the second shoulder means; and, a lower end contacting the annular means. The annular means and conduit means are displaced in said housing between at least two operative positions, a first operative position with the annular means contacting the first shoulder means and without fluid flowing under pressure into the first end of the housing and against the annular means, and a second operative position. In the second operative position, fluid flows under pressure into the first end of the housing and against the annular means; the upper end of the conduit means extends through the second open end of the housing; and, the annular means contacts the second shoulder means. The fluid flow against the annular means produces a displacement force causing the annular means to move in a direction of travel from the first to the second operative position and to impact the second shoulder means. At least one of the annular means and the inner wall are shaped and dimensioned to permit fluid flow intermediate the annular means and inner wall and intermediate the outer wall of the conduit means and the inner wall of the housing. The fluid flow intermediate the outer wall and inner wall produces turbulent fluid flow intermediate the annular means and second shoulder means to generate forces resisting movement of the annular means and conduit means from the first to the second operative position; and, reduces the impact force of the annular means against the second shoulder means.

Turning now to the drawings, which depict the presently preferred embodiments and best mode of the invention for the purpose of illustrating the practice thereof and not by way of limitation of the scope of the invention and in which like reference characters represent corresponding elements throughout the several views, FIGS. 1–9 illustrate apparatus constructed in accordance with the principles of the invention. In FIG. 1 conduits 23 connect hydraulically actuated nozzle units 10 with fluid distribution means 24. Distribution means 24 receives water or another fluid from a source of pressurized fluid and dispenses it to conduits 23 leading to nozzle units 10. Fluid distribution means 24 sequentially applies pressurized fluid flow to conduits 23. Hydraulically actuated nozzle units 10 are preferably countersunk in a swimming pool 25 or other fluid container in the manner illustrated in FIG. 1.

Figure 4:
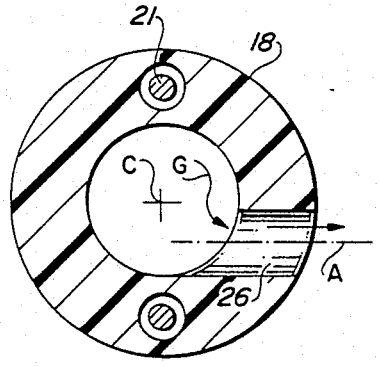
FIG. 4 is a top section view of the fluid dispensing component of FIG. 3 taken along section line 4—4 thereof and illustrating interior construction details thereof.

In FIGS. 2 to 4, hydraulically actuated nozzle unit 10 includes housing 11 fixedly attached to conduit 23 and having a first open end 13 and a second open end 12. A first outwardly depending shoulder or stop 15 and a second outwardly depending shoulder or stop 14 are attached to inner cylindrical wall 16 of housing 10. The fluid dispensing component movably mounted in housing 10 for captive reciprocating displacement therein includes annular weight means 17 and cylinder 18. Screws 21 secure cylinder 18 to annular weight 17 in the manner shown in FIGS. 2 and 2A. Outlet channel 26 is formed in cylinder 18. Annular means 17 has a circular outer periphery excepting for a planar faces 31 and 32. Dashed lines 30 represent the periphery which annular weight means 17 would have if it were completely circular. The shortest distance from planar face 31 to planar face 32 is slightly less than the inner diameter of shoulder 14. This permits weight means 17 to be inserted in housing 10 by turning weight means 17 on end in the manner indicated by dashed lines 17 in FIG. 3 and sliding means 17 downwardly through end 12 of housing 10 and toward open end 13.

Elongate vertically oriented groove 33 is formed in inner wall 16. If desired a plurality of spaced apart grooves 33 can be formed in wall 16, or inner wall 16 can, instead of being cylindrical, take on a concave elliptical contour. The concave elliptical contour of inner wall 16 can be visualized by imagining a plurality of parallel grooves 33 formed in wall 16 without spaces between the grooves.

Figure 7:
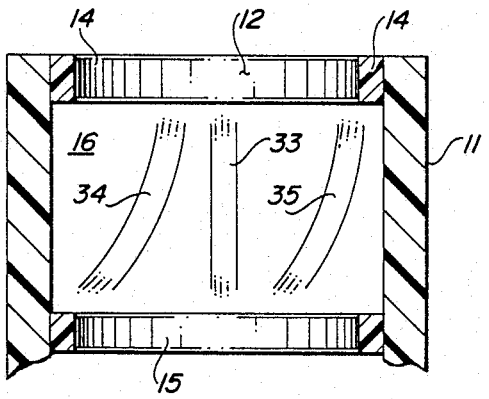
FIG. 7 is a partial front section view illustrating another embodiment of the nozzle unit housing and taken along section lines 7—7 of FIG. 1.

In FIG. 7, annular weight means 17 and cylinder 18 have been omitted for the sake of clarity. In addition to vertical elongate groove 33, arcuate grooves 34 and 35 are formed in inner wall 16. As shown in FIG. 3, groove or grooves 36 can be formed in outer wall or face 18F of cylinder 18. Arcuate grooves similar to grooves 34 and 35 can be formed in face 18F.

As shown in FIGS. 2, 2A and 3, aperture 37 is formed in cylinder 18. The outer diameter of annular weight means 17 is indicated by arrows D and is slightly less than the diameter, indicated by arrows E, of inner cylindrical wall 16 of housing 11 such that means 17 can be slidably vertically displaced along wall 16 in housing 11. The diameter of face 18F is less than the inner diameter of shoulder or stop 14.

As shown in FIG. 2, when there is no fluid flowing under pressure from conduit 23 through end 13 toward end 12, the force of gravity maintains the fluid dispensing component in position against shoulder or stop 15. When fluid flows under sufficient pressure through conduti 23 and into housing 10 in the direction indicated by arrows F in FIG. 2A, the fluid generates a displacement force against weight means 17 which displaces weight means 17 and cylinder 18 upwardly from stop 15 toward stop 14. The vertical displacement of the fluid dispensing component is halted when annular weight means 17 contacts shoulder 14 in the manner indicated in FIG. 2A. When the displacement force maintains annular weight means 17 in contact with shoulder 14, the upper end 18A extends outwardly through the second open end 12 of housing 10. When cylinder 18 is in the position illustrated in FIG. 2A, fluid flows through and outwardly from cylinder 18 in the direction indicated by arrows G in FIGS. 2A and 4. Aperture 26 is formed in cylinder 18 such that the flow of water through aperture 26 imparts a force to the fluid dispensing component which tends to rotate the component about the longitudinal centerline of cylindrical housing 10 and conduit 23 in FIGS. 2 and 2A. This longitudinal centerline is, in FIG. 4, perpendicular to point C.

FIGS. 2, 3 and 5 illustrate how the shape and dimension of annular weight means 17, inner wall 16, and cylinder 18 produce fluid flow forces which lessen the upward displacement forces produced by fluid flow F against annular weight means 17 and tend to buffer the impact of annular means 17 against shoulder or stop 14 when fluid flows through housing 11 under pressure. When fluid initially begins to flow F through conduit 23 into housing 11, cylinder 18 and weight means 17 begin to move upwardly away from stop 15 toward stop 14. As soon as weight means 17 moves out of contact with stop 15 fluid begins to flow through groove 33, around vertical planar surfaces 32 and 31 of annular means 17, intermediate wall 18A and stop 14, and through aperture 37 of cylinder 18 in the manner indicated by arrows S in FIGS. 2A and 5. The flow of fluid intermediate wall 16 and means 17 and cylinder 18 creates a "buffer pressure" inherent in the flow of any fluid and creates turbulence which partially counteracts the upward displacement forces generated by the flow F of fluid against bottom 17B of annular weight means 17. As used herein, the term "buffer pressure" refers to the type of pressure encountered when trying to drink water which is flowing in a cylindrical stream from the end of a garden hose. When an individual attempts to close or "clamp" his mouth on the cylindrical stream of water flowing out of the hose, the inertia of water flowing in a direction of travel generally perpendicular to the side of the head of the individual attempting to drink from the stream of water creates a force which resists closing of the mouth on a stream of water. Accordingly, the flow of fluid intermediate wall 16 and weight means 17 and cylinder 18 creates forces resisting the upward displacement of annular means 17 from stop 15 to stop 14. The flow of fluid outwardly through aperture 37 in the direction of arrow S in FIG. 2A also reduces the upward displacement force generated against means 17 by fluid flow F and reduces the force of impact of means 17 against stop 14. The turbulence caused by fluid flowing intermediate wall 16 and cylinder 18 and means 17 causes fluid to temporarily flow in the directions indicated by arrows T in FIG. 5. The lower edge of stop 14 and the upper edges of faces 32 and 33 help generate such turbulent flow as fluid attempts to flow around the same. Apertures, indicated by dashed lines 41 and 42 in FIG. 5, can be formed through any of stop 14, housing 11, means 17 and cylinder 18 to permit fluid, indicated by arrows W, to flow therethrough to reduce the upward lifting force generated against weight means 17 and cylinder 18 by fluid flow F.

The outer circular planar vertical peripheral face of means 17 is indicated in FIG. 3 by reference character 44. As would be appreciated by those of skill in the art, small grooves comparable in shape to grooves 33, 34 and 35 can be formed in faces 31, 32 and 44 of means 17. When a fluid flows upwardly toward stop 14 through grooves 34 and 35 in wall 16, the fluid tends to impart a frictionally induced rotational force to face 18F which causes cylinder 18 and means 17 to rotate about the longitudinal colinear center axes of conduit 23 and cylinder 18.

Figure 6:
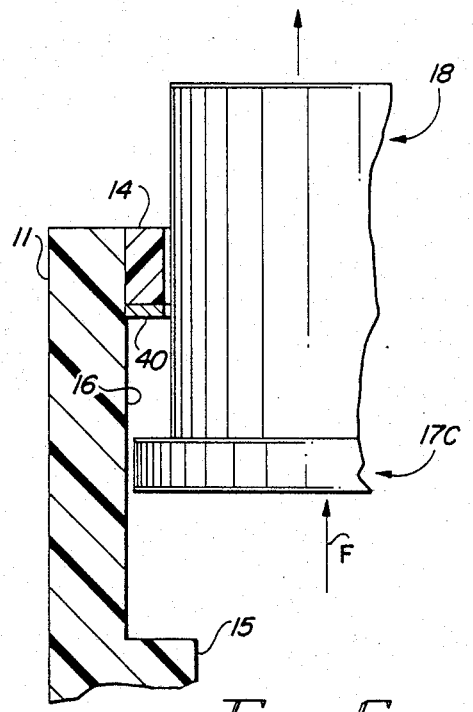
FIG. 6 is a partial front section view of the nozzle unit of FIGS. 2 and 3 illustrating an alternate embodiment thereof.

In the alternate embodiment of the invention illustrated in FIG. 6, annular weight means 17C is identical to means 17 of FIG. 3 except that means 17C has a circular outer periphery in the manner indicated by dashed lines 30 in FIG. 3. Means 17C does not include planar faces 31 and 32. Further, grooves 33, 34 and 35 are not formed in wall 16. Consequently, when means 17 and cylinder 18 are in the position shown in FIG. 6, a fluid cannot readily flow intermediate wall 16 and means 17C and cylinder 18. A circular resilient gasket is attached to the bottom of stop 14 to absorb a portion of the impact force of means 17 against stop 14. Gasket 40 can, if desired, be attached to the top of means 17 or can be slidably placed on cylinder 18 to "float" or ride intermediate weight means 17 and stops 14 and 15.

Apertures 42 (FIG. 5) can be formed such that the flow of fluid therethrough under pressure tends to cause weight means 17 and cylinder 18 to rotate about the vertical longitudinal center axis of conduit 23 and cylinder 18 in FIG. 2A.

Figure 8:
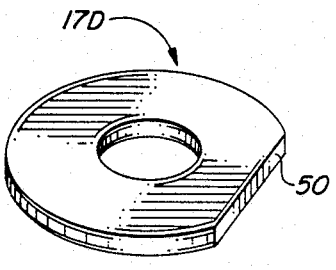
FIG. 8 is a perspective view illustrating an alternate embodiment of the annular means of the nozzle unit of the invention; and, FIG. 9 is a perspective view illustrating another embodiment of the annular means of the nozzle unit of the invention.
Figure 9:
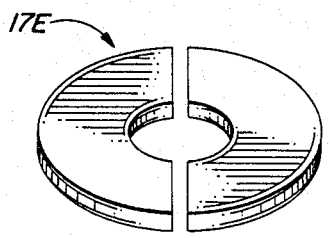

Means 17 can be made 17D with only a single planar face 50 as shown in FIG. 8. Means 17 can also be made 17E in two separate halves to facilitate insertion of means 17E inside housing 11.

Having described our invention in such terms as to enable those skilled in the art to understand and practice it, and having identified the presently preferred embodiments thereof, I claim:

1. A hydraulically actuated nozzle unit, including (a) a housing having (i) first and second open ends, (ii) a cylindrical inner wall, (iii) first shoulder means attached to and inwardly extending from said inner wall, and (iv) second shoulder means spaced apart from said first shoulder means and inwardly extending from said inner wall;

(b) annular means interposed in said housing between said first and second shoulder means for captive slidable displacement therebetween;

(c) cylindrical conduit means connected to and extending away from said annular means toward said second end of said housing and having (i) an upper end having an outer cylindrical wall spaced apart from said inner wall of said housing and said second shoulder means, and (ii) a lower end contacting said annular means, said annular means and conduit means being displaced in said housing between at least two operative positions, (iii) a first operative position with said annular means contacting said first shoulder means and without fluid flowing under pressure into said first end of said housing and against said annular means, and (iv) a second operative position with fluid flowing under pressure into said first end of said housing and against said annular means, said upper end of said conduit means extending through said second open end of said housing, and said annular means contacting said second shoulder means, said fluid flow against said annular means producing a displacement force causing said annular means to move in a direction of travel from said first to said second operative position and to impact said second shoulder means, said annular means and inner wall being shaped and dimensioned to permit fluid flow intermediate said annular means and inner wall, and said outer wall of said conduit means and said inner wall of said housing (d) at least one elongate groove formed in said cylindrical inner wall of said housing intermediate said first and second shoulder means, said groove having (i) a lower end through which a portion of said fluid flowing under pressure into said housing enters said groove, and (ii) an upper end from which fluid flowing through said groove toward said second shoulder means exits said groove, said groove being shaped and dimensioned such that when said annular means and conduit means are intermediate said first and second operative positions, said portion of said fluid flowing into said groove (iii) initially flows away from said outer cylindrical wall of said cylindrical conduit means, and (iv) flows through said upper end beneath said second shoulder means toward said outer cylindrical wall and generally perpendicular to the direction of travel of said annular means and conduit means from said first to said second operative position, said flow of fluid from said upper end of said groove (v) causing fluid flow intermediate said annular means and said second shoudler means to generate buffer pressure resisting movement of said annular means from said first to said second operative position, and (vi) reducing said impact force of said annular means against said second shoulder means.

2. The nozzle unit of claim 1 wherein said portion of said fluid moving through said groove has an angular momentum and is acted on by a centripetal force.

* * * * *